US007895961B2

(12) United States Patent
Zuniga et al.

(10) Patent No.: US 7,895,961 B2
(45) Date of Patent: Mar. 1, 2011

(54) ANCHOR PROTECTOR

(76) Inventors: Michael Zuniga, Costa Mesa, CA (US); Fidel Zuniga, Costa Mesa, CA (US)

( * ) Notice: Subject to any disclaimer, the term of this patent is extended or adjusted under 35 U.S.C. 154(b) by 147 days.

(21) Appl. No.: 12/423,068

(22) Filed: Apr. 14, 2009

(65) Prior Publication Data

US 2010/0258047 A1 Oct. 14, 2010

(51) Int. Cl.
*B63B 21/24* (2006.01)

(52) U.S. Cl. ..... 114/294

(58) Field of Classification Search ..... 114/294; 150/154

See application file for complete search history.

(56) References Cited

U.S. PATENT DOCUMENTS

| | | | | | |
|---|---|---|---|---|---|
| 2,714,912 | A * | 8/1955 | Gonnella | 150/154 |
| 3,274,969 | A * | 9/1966 | Baas | 114/309 |
| 3,704,738 | A * | 12/1972 | LeCompte | 150/154 |
| 4,165,659 | A * | 8/1979 | Fawley | 74/558 |
| 4,374,534 | A * | 2/1983 | Jespers et al. | 52/3 |
| 4,972,857 | A * | 11/1990 | Stewart et al. | 132/73 |
| 5,327,844 | A * | 7/1994 | Kress | 114/218 |
| 5,524,569 | A * | 6/1996 | Rich et al. | 114/294 |
| 5,664,975 | A * | 9/1997 | Carlisle | 440/49 |
| 5,743,458 | A * | 4/1998 | French | 229/87.03 |
| 6,055,923 | A * | 5/2000 | Militzer | 114/210 |
| 6,626,123 | B1 * | 9/2003 | MacKarvich | 114/304 |
| 2008/0264532 | A1 * | 10/2008 | Wilson | 150/154 |

* cited by examiner

*Primary Examiner* — Stephen Avila
(74) *Attorney, Agent, or Firm* — Vladi Khiterer

(57) ABSTRACT

An anchor protector attaches to a protruding stock of a boat anchor and minimizes damage from impact with the protruding stock. The anchor protector is buoyant and can accommodate the protruding stock of various diameters.

4 Claims, 2 Drawing Sheets

ANCHOR PROTECTOR

BACKGROUND

Many anchors used for recreational boating comprise a stock, i.e. a horizontal bar at the crown to which two large flat surfaces with sharp ends (flukes) are attached. The stock is hinged so the flukes can orient toward the bottom (and on some designs may be adjusted for an optimal angle depending on the bottom type.) The flukes are designed to penetrate the bottom and bury the anchor. Once buried, the anchor develops a sufficient amount of resistance.

The stock ends are exposed and protrude from the sides of the anchor. Impact with the stock can cause damage to the boat, property, and injuries to persons.

It is desirable to have means to cover the protruding ends of the stock to prevent or minimize the damage. Conventionally, a number of makeshift means is employed to cover the stock, such as attaching tennis balls and the like to the stock. Such makeshift means are inconvenient, easily lost and do not stay buoyant if dropped in the water.

Accordingly, there is need for the means to cover the protruding ends of the stock that does not fall off the ends of the stock and remains buoyant in the water.

SUMMARY OF THE INVENTION

The anchor protector of this invention satisfies this need. The anchor protector attaches to a protruding stock of a boat anchor and minimizes damage from impact with the protruding stock. The anchor protector is buoyant and can accommodate the protruding stock of various diameters. The anchor protector comprises a conical impact absorber having a neck portion with a sleeve adapted for receiving the protruding stock and removably attaching the anchor protector to the protruding stock by way of a force of friction. The diameter of the sleeve can be made to accommodate various sizes of the stock. The impact absorber has an airtight cavity that provides positive buoyancy for the anchor protector.

DESCRIPTION OF THE INVENTION

Figure 1:
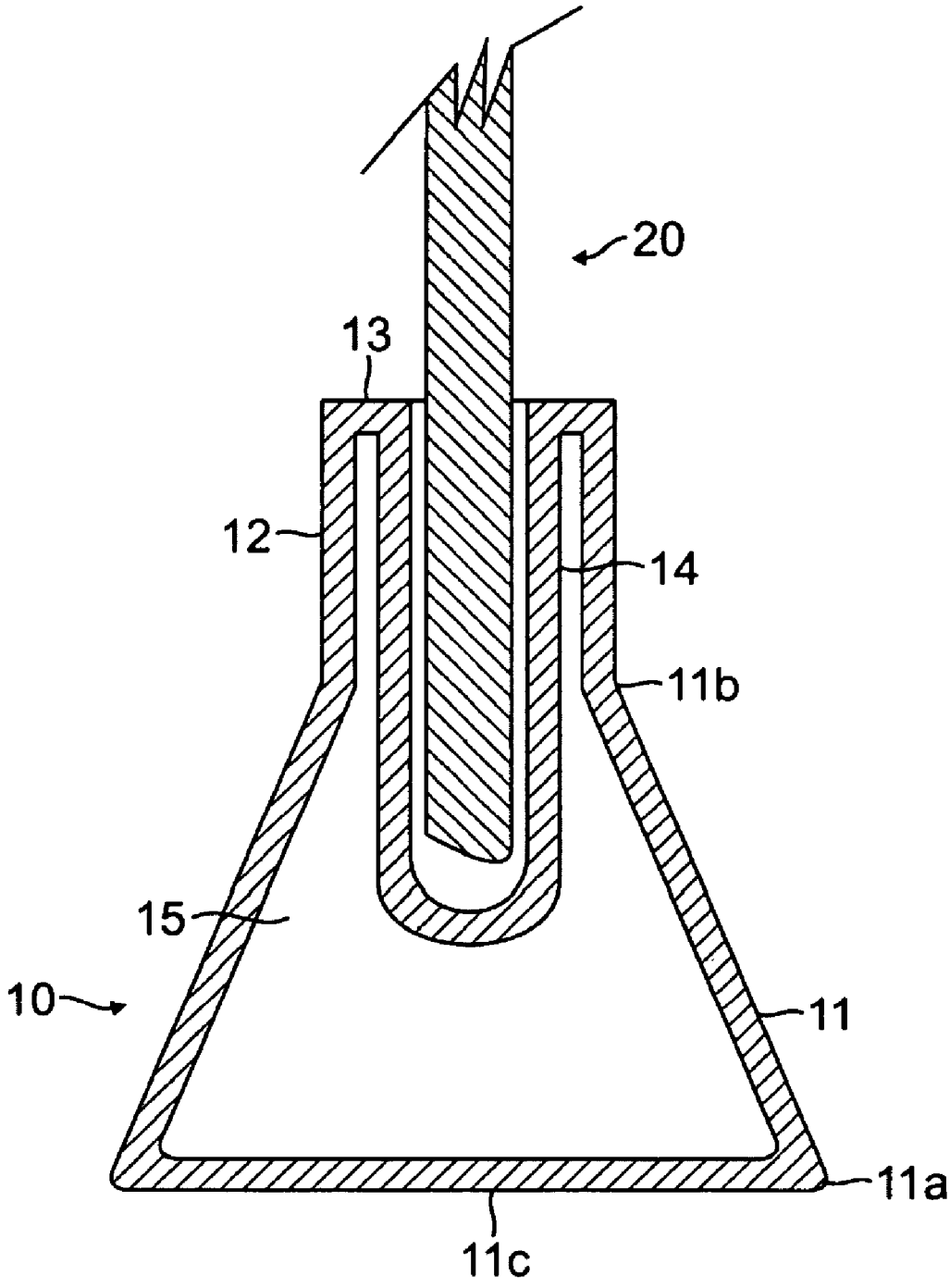
FIG. 1 is a cross-sectional view of the anchor protector according to this invention, attached to a stock.
Figure 2:
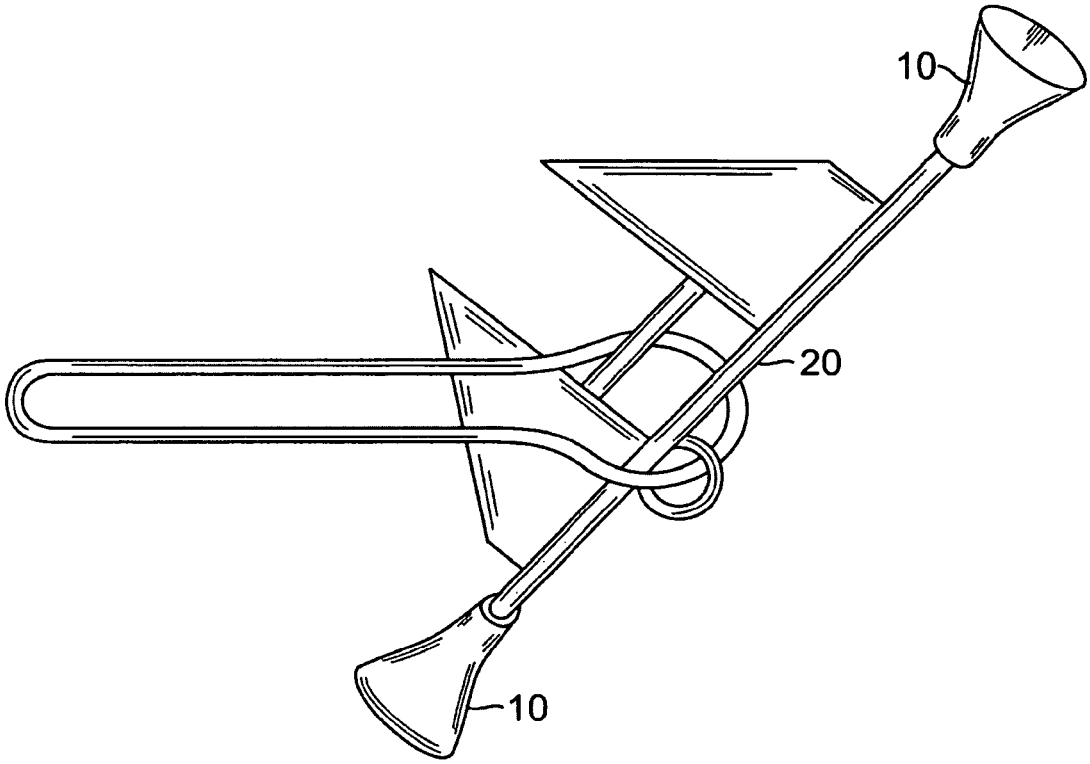
FIG. 2 is a perspective view of a fluke-type boat anchor with two anchor protectors according to this invention attached to protruding ends of the stock.

The preferred embodiment of this invention will be better understood in reference to FIG. 1 and FIG. 2. The same numerals refer to the same elements in both FIG. 1 and FIG. 2.

Viewing now FIG. 1, it shows a cross-sectional view of the anchor protector attached to a stock. Numeral 10 indicates an anchor protector. Numeral 20 indicates a stock.

Anchor protector 10 comprises of a conical impact absorber indicated by numeral 11. Impact absorber 11 is formed from a plastic material. In the preferred embodiment, impact absorber 11 is formed from high impact polystyrene. High impact polystyrene is relatively light weight and strong to withstand impact that the boat anchor may encounter with the boat or other objects. At the same time, high impact polystyrene provides adequate protection to persons and property from the impact with protruding ends of the stock. Impact absorber 11 can be made by molding or extrusion.

Conical shape of impact absorber 11 provides strength to combat forces of impact between anchor and other objects.

Impact absorber 11 comprises a base end indicated by numeral 11*a* and an apex end indicated by numeral 11*b*. Base end 11*a* terminates in base indicated by numeral 11*c*. Base 11*c* is substantially planar.

Numeral 12 indicates a cylindrical neck. Neck 12 extends outwardly from apex end 11*b*, terminating in a cap indicated by numeral 13. Cap 13 is substantially planar and is opposite to apex end 11*b*. Neck 12 is formed from a plastic material integrally with impact absorber 11. In the preferred embodiment, neck 12 is formed from high impact polystyrene.

Numeral 14 indicates a sleeve. Sleeve 14 extends inwardly from cap 13 along the longitudinal axis of impact absorber 11. Sleeve 14 is adapted for receiving stock 20 and removably attaching anchor protector 10 to stock 20 by way of a force of friction.

The diameter of sleeve 14 can be made to accommodate various sizes of stock 20. Popular sizes for stock are ¾", ⅞", 1", 1⅛", 13/32", ⅝". The diameter of sleeve 14 must be slightly larger than the diameter of stock 20 while keeping stock 20 tightly engaged, by force of friction, inside sleeve 14.

Anchor protector 10 has positive buoyancy. In the preferred embodiment, the positive buoyancy is achieved by an airtight cavity indicated by numeral 15. Airtight cavity 15 is formed inside impact absorber 11.

Viewing now FIG. 2, two anchor protectors 10 are attached to each protruding end of stock 20, thereby minimizing damage from impact with stock 20.

While the present invention has been described and defined by reference to the preferred embodiment of the invention, such reference does not imply a limitation on the invention, and no such limitation is to be inferred. The invention is capable of considerable modification, alteration, and equivalents in form and function, as will occur to those ordinarily skilled and knowledgeable in the pertinent arts. The depicted and described preferred embodiment of the invention is exemplary only, and is not exhaustive of the scope of the invention. Consequently, the invention is intended to be limited only by the spirit and scope of the appended claims, giving full cognizance to equivalents in all respects.

We claim:

1. In combination with a boat anchor having a protruding stock, an anchor protector for minimizing damage from impact with the protruding stock, comprising:

a conical impact absorber formed from a plastic material, the impact absorber comprising a base end and an apex end, the base end terminating in a substantially planar base;

a cylindrical neck formed from a plastic material integrally with the impact absorber, the neck extending outwardly from the apex end, terminating in a substantially planar cap opposite to the apex end;

a sleeve extending inwardly from the cap along the longitudinal axis of the impact absorber, the sleeve adapted for receiving the protruding stock and removably attaching the anchor protector to the protruding stock by way of a force of friction.

2. The anchor protector as in claim 1, wherein the plastic material is high impact polystyrene.

3. The anchor protector as in claim 2, wherein the anchor protector has positive buoyancy.

4. The anchor protector as in claim 3, wherein said positive buoyancy is achieved by an airtight cavity formed inside the impact absorber.

* * * * *